United States Patent [19]

Barnes et al.

[11] Patent Number: 4,753,164

[45] Date of Patent: Jun. 28, 1988

[54] ADJUSTABLE POCKET PRINTING PLATEN

[76] Inventors: David W. Barnes, 12 Raven Pl., Audubon, N.J. 08106; Gregory C. Janice, 203 Shalstone La., Marlton, N.J. 08053

[21] Appl. No.: 28,455

[22] Filed: Mar. 20, 1987

[51] Int. Cl.[4] ..... B41F 17/38

[52] U.S. Cl. ..... 101/126; 101/129; 108/143

[58] Field of Search ..... 101/407 BP, 407 R, 126, 101/129; 248/298; 108/102, 143

[56] References Cited

U.S. PATENT DOCUMENTS

| | | | |
|---|---|---|---|
| 1,258,230 | 3/1918 | Lewis et al. | 108/143 |
| 2,483,920 | 10/1949 | McLean et al. | 108/143 X |
| 2,963,967 | 12/1960 | Baker et al. | 101/407 R |
| 3,092,024 | 6/1963 | Wagner | 101/407 R X |
| 3,135,198 | 6/1964 | Kingsley | 101/407 BP |
| 3,140,658 | 7/1964 | Marshall | 101/407 BP |
| 3,244,093 | 4/1966 | Vasilantone | 101/407 BP |
| 3,507,217 | 4/1970 | Forslund | 101/407 R |

*Primary Examiner*—Clifford D. Crowder
*Attorney, Agent, or Firm*—Steele, Gould & Fried

[57] ABSTRACT

An adjustable pocket printing platen is disclosed for use with the printing platen of a prior art type of silk screen printing machine. The adjustable pocket printing platen includes a frame having a pair of spaced, transverse rails having end flanges positioned to bottomly underly the marginal edges of the machine platen. Thumb screws extend through the bottom flanges to lock the pocket printing platen to the machine platen in any longitudinally adjusted position. A small platen transversely rides along the transverse rails and is sized to receive and support the pocket of a garment thereupon. Set screws extend through marginal edges of the small platen to lock the platen to the transverse rails in any desired transversely adjusted position. The top surface of the small platen extends above the top surface of the machine platen to receive the printing screen when it is lowered to apply a screened design to a garment pocket.

18 Claims, 2 Drawing Sheets

ADJUSTABLE POCKET PRINTING PLATEN

BACKGROUND OF THE INVENTION

1. Field of the Invention

The present application relates generally to silk screen printing systems, and more particularly, is directed to an adjustable pocket printing platen suitable for adjustably securing to any known type of silk screen printing machine to readily affix a small pocket or logo printing platen in any predetermined position upon the existing printing platen.

2. Discussion of the Prior Art

Silk screen printing is a popular art throughout the United States and in most foreign countries for applying artistic designs upon fabrics or upon finished articles of apparel, such as T-shirts. More recently, multicolor silk screen printers have become available to allow the rapid printing of previously designed patterns upon various materials such as textiles, paper, finished articles of clothing and the like.

Specialized multi-color printers have now been designed to facilitate the easy printing of multi-color designs upon a single workpiece, for example a popular article of wearing apparel such as a T-shirt. Companies such as Atlas Screeen Printing, Inc. of Chicago, Ill. have advertised a variety of highly efficiet multicolor printing systems to facilitate rapid and inexpensive silk screen printing directly on T-shirts. Such machines are characterized by a sturdy central work table having two or more work stations extending thereform. Each work station usually comprises generally a longitudinally adjustable planar printing platen for receiving and properly positioning the T-shirt or other textile thereupon. A printing head is pivotal above the platen and includes a suitable screen holder and means for applying the color. By pivoting the printing head downwardly to the printing platen, the silk screened design can then be applied directly upon the platen supported garment or fabric in the usual manner. When more than one color is to be printed, an additional work station is employed for each color to be applied. The screens are maintained in exact registry in the printing heads so that the various colors, when applied to the screen, will be applied in precisely the predetermined, desired location.

Such prior art silk screen printing devices are highly efficient in operation and are generally satisfactory for the purpose intended. However, problems have arisen when it is desired to print only a small design or logo in a particular location upon a garment. This has proved to be an expensive and inexact exercise when using existing equipment.

For example, when it is desired to print a design directly only upon the pocket of a T-shirt or other garment, the prior operators have found that it is a time consuming and tedious chore to precisely align the pocket with the screen so that the logo or other design can be applied in precisely the correct location. Most often, in view of the difficulties experienced in properly placing a pocket silk screened design, such designs cannot be properly applied and are therefore usually not offered to the public in the same manner that full body designs are generally provided.

SUMMARY OF THE INVENTION

The present invention relates generally to silk screen printing devices, and more particularly, is directed to a completely adjustable pocket printing platen that is compatible for use with existing silk screen printing machines and which permits precise printing of a logo or other pocket design directly upon the pocket itself or upon any predetermined location or portion of a garment or textile.

The adjustable platen of the present invention is designed for use with existing silk screen printing machines and includes easily adjustable clamping features to permit the pocket platen to be securely affixed to the existing silk screen printing machine platen in a predetermined location. The pocket platen of the present invention is smaller than the existing machine platen and is provided with adjustable means to permit precise placement of the pocket platen over the machine platen in an easily adjustable manner.

The adjustable pocket printing platen of the present invention comprises generally a pocket platen and a pair of spaced, transversely extending rails which are intended to overfit the printing platens of the more popular types of silk screen printing machines. The rails are preferably fabricated of steel of sufficient length to extend across the entire width of the printing machine platen. At each end of the rails is secured a clamping means which comprises a bottom flange to bottomly underly the left and right marginal edges of the printing machine platen. Thumb screws or other securing means extend through each of the left and right flanges to bear against the bottom of the machine platen in a manner to longitudinally secure the pocket platen in position. When it is desired to longitudinally move the pocket platen relative to the machine platen, all that is necessary is to loosen the left and right thumb screws and then move the transversely oriented guide rails forwardly or rearwardly along the machine platen until the desired longitudinal location is reached. With the rails thus positioned, the bottom thumb screws can again be tightened to thereby secure the pocket platen in a desired longitudinally adjusted position.

The pocket platen is transversely movable along the guide rails and means are provided to transversely secure the pocket platen in a predetermined transverse position along the guide rails. In a preferred embodiment, socket set screws can be threadedly engaged within threaded openings in the forward and rearward edges of the pocket platen in a manner to bear against opposing sides of the guide rails. When it is desired to transversely move the pocket platen to another transverse position relative to the printing machine plate, the two socket set screws can be threadedly backed from the guide rails and then the pocket platen is free to transversely move along the guide rails. When the desired transverse position of the pocket platen is reached, the socket set screws can again be tightened to thereby lock the pocket platen in the desired transverse positon relative to the printing machine platen.

The pocket platen has its planar printing surface securely positioned above the top of the printing machine platen and above the top of the guide rails whereby the first contact of the printing screen when pivotally lowered will be with the printing surface of the pocket platen. Accordingly, by positioning only the pocket of the garment on the pocket printing platen, only that portion of the garment will be printed with the screened design during the printing operation. Accordingly, once the pocket printing platen is aligned with the screened design that is to be applied the pocket, then no further adjustments will be required. Once the pocket printing platen is properly located, precise and accurate pocket printing can then proceed with great speed and with great accuracy simply by properly positioning the garment pocket (or other area to be imprinted) on the pocket platen.

It is therefore an object of the present invention to provide an improved adjustable pocket printing platen of the type set forth.

It is another object of the present invention to provide a novel pocket printing platen that is precisely adjustable upon a silk screen printing machine platen and which is compatible for use with existing silk screen printing machines.

It is another object of the present invention to provide a novel adjustable pocket printing platen comprising a small platen of size to support a garment pocket, a pair of transversel extending guide rails movably carrying the pocket platen, means to secure the pocket platen to the guide rails in an infinite number of transversely adjustable positions, flange means secured to the ends of the guide rails, the flange means comprising securing means to secure the pocket platen in an infinite number of longitudinally adjusted position relative to the printing machine platen.

It is another object of the present invention to provide a novel adjustable pocket printing platen comprising a pocket platen of size to receive a garment pocket thereon, means to secure the pocket platen to a silk screen printing machine platen, means to adjust the longitudinal position of the pocket platen relative to the machine platen and means to adjust the transverse position of the pocket platen relative to the silk screen machine platen.

It is another object of the present invention to provide a novel adjustable pocket printing platen that is simple in design, inexpensive in manufacture and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENT OF THE INVENTION

Figure 1:
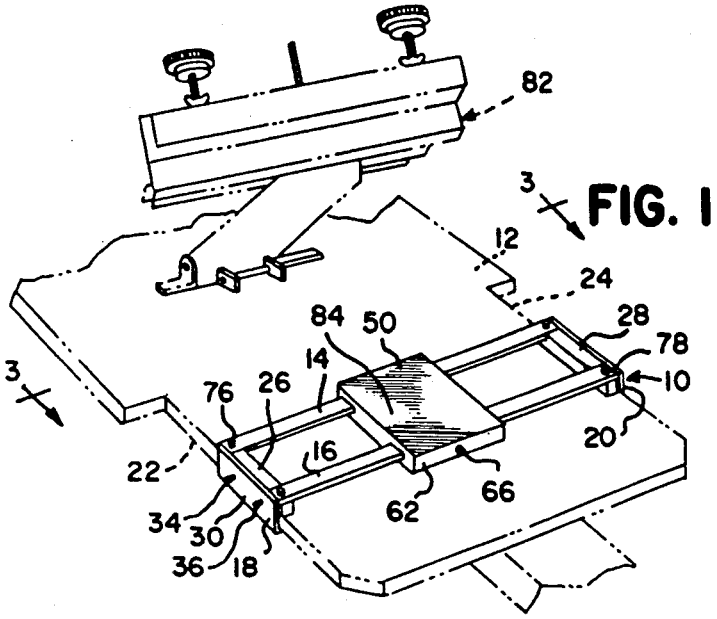
FIG. 1 is a perspective view of an adjustable pocket printing platen of the type set forth applied to an existing silk screen printing machine platen wherein the existing parts are illustrated in phantom lines for purposes of association.

Although specific terms are used in the following description for the sake of clarity, these terms are intended to refer only to the particular structure of the invention selected for illustration in the drawings, and are not intended to define or limit the scope of the invention.

Figure 6:
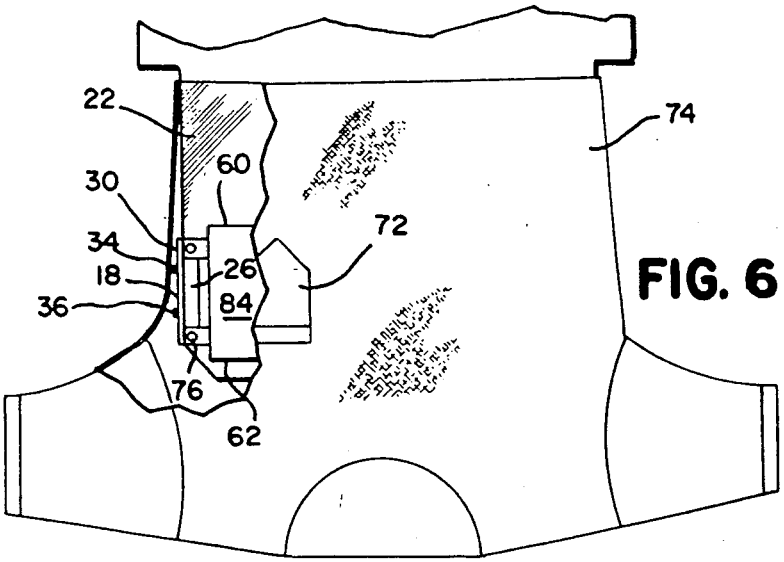
FIG. 6 is a perspective view showing the pocket printing platen in use.

Referring now to the drawings, there is illustrated in FIG. 1 an adjustable pocket printing platen generally designated 10 which is adjustably secured upon a conventional silk screen printing machine platen 12 in a manner to facilitate printing a pocket design or logo upon a garment pocket 72 (FIG. 6) or other precise location on a T-shirt 74 or other item of apparel or piece of textile fabric as may be desired.

Figure 2:
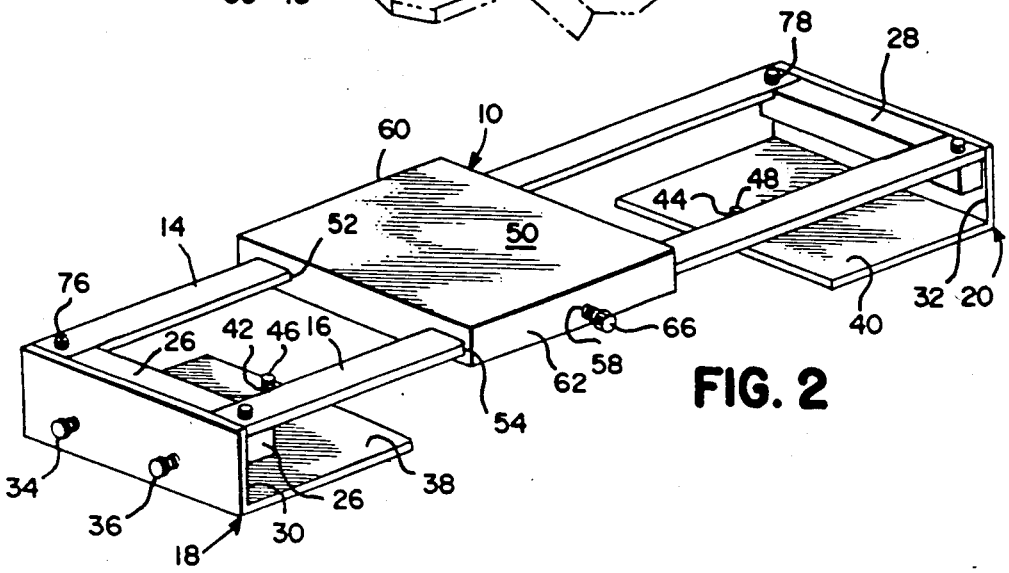
FIG. 2 is a side enlarged, perspective view of the adjustable pocket printing platen.
Figure 5:
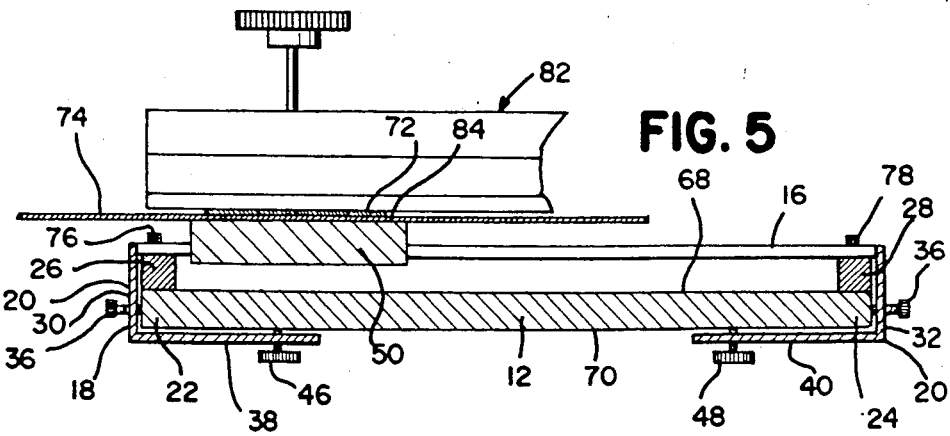
FIG. 5 is a cross sectional view taken along line 5—5 on FIG. 3, looking in the direction of the arrows.
Figure 3:
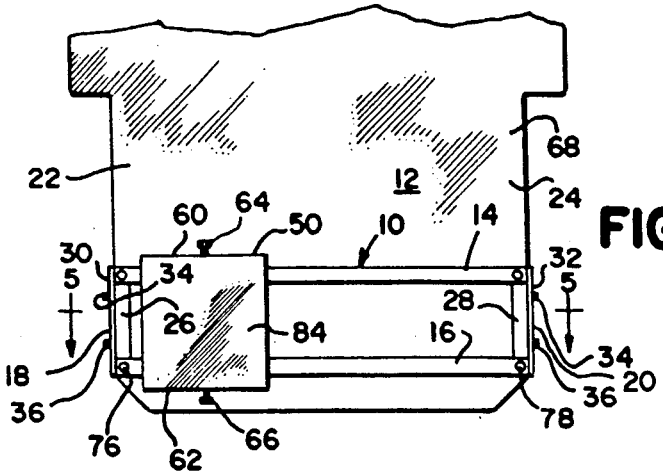
FIG. 3 is a top plan view of the pocket printing platen looking from line 3–3 on FIG. 1.
Figure 4:
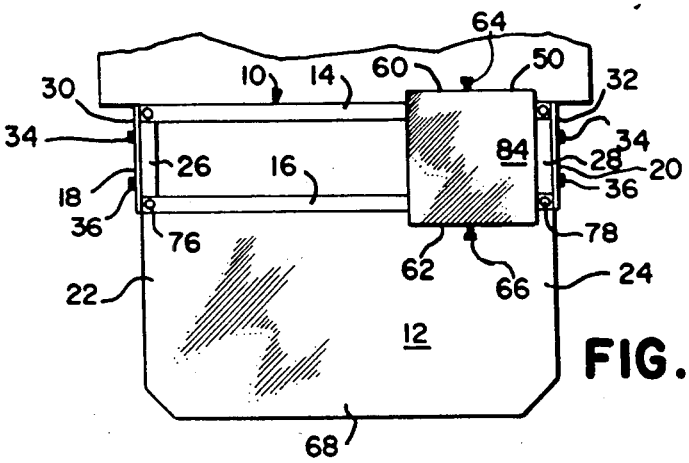
FIG. 4 is a top plan view similar to FIG. 3, showing the pocket printing platen moved and secured in a different location upon the machine printing platen.

Still referring to FIG. 1, and further considering FIGS. 2, 3 and 4, the adjustable pocket printing platen 10 of the present invention comprises generally a pair of transverse rails 14–16 of length sufficient to extend completely across the existing silk screen printing machine platen 12. Accordingly, if the existing machine platen 12 is, for example, fiften inches in width, then the transverse rails 14, 16 should be fabricated of sufficient length to extend completely across the existing platen with sufficient clearance to allow the end flanges 18, 20 to grip the left and right marginal areas 22, 24 of the machine platen 12 in the manner hereinafter more fully set forth. The transverse rails 14, 16 are preferably fabricated of three/eighths inch square steel bar stock to provide a sturdy undercarriage for the small pocket printing platen 50 during the pocket silk screening operation.

As shown, left and right steel spacers 26, 28 secure to and space the respective left and right ends of the rails 14, 16 in known manner, for example, by employing a plurality of endwardly positioned socket set screws 76, 78, to provide an extremely sturdy construction. The left and right flanges 18, 20 may be L-shaped in configuration and have their respective upright legs 30, 32 affixed to the outer faces of the left and right spacers 26, 28 in known manner, for example by employing one or more socket set screws 34, 36 which extend through registered, threaded openings in the flange upright legs 30, 32 and the spacers 26, 28 in known manner.

The upright legs 30, 32 of the flanges terminate upwardly in alignment with the top surfaces of the guide rails 14, 16 and extend downwardly below the bottoms of the transverse rails sufficiently to permit the horizontal flanges legs 38, 40 to extend below the bottom surface 70 of the machine platen 12 in respective registry below the left and right platen marginal areas 22, 24. Each horizontal leg 30, 34 is provided with a threaded opening 42, 44 to threadedly receive a conventional thumb screw 46, 48 therewithin to permit easy security of the adjustable platen 10 to the fixed machine platen 12.

A small platen 50 of size to receive a pocket-shaped design or other small size logo slidingly overfits the guide rails 14, 16 and is provided with bottom transverse grooves or tracks 52, 54 of size to slidingly respectively receive the transverse rails 14, 16. Forward and rearward threaded opening 58 extends inwardly from the respective forward and rearward faces 60, 62 of the platen 50 and terminate respectively at the bottom tracks 52, 54. Forward and rearward set screws 64, 66, which preferably are socket type set screws, are threadedly engaged within the threaded openings 58 in a manner to facilitate locking the small platen 50 in any transversely adjusted position along the transverse rails 14, 16.

In order to use the adjustable pocket printing platen of the present invention, the device is intended for use upon the existing platen 12 of a conventional silk screen printing machine (not shown). The left and right horizontal legs 38, 40 of the left and right flanges 18, 20 are urged under the left and right marginal edges 22, 24 of the machine platen 12 with the transverse guide rails 14, 16 riding over the top surface 68 of the machine platen 12. The adjustable device 10 is then urged longitudinally over the machine platen 12 until the desired longitudinally adjusted position is reached. Then, the flange thumb screws 46, 48 are turned until the screws contact and bear against the bottom surface 70 of the machine platen 12. After the longitudinal position of the small platen 50 relative to the machine plate 12 is determined, the forward and rearward set screws 64, 66 are loosened and the small platen 50 can be urged transversely along the rails 14, 16 until the desired transversely adjusted position of the small platen 50 relative to the machine platen 12 is reached. When the small platen 50 is properly positioned, the set screws 64, 66 can be tightened in well known manner and then the small platen 50 will be properly transversely and longitudinally positioned.

Once the small platen 50 has been properly positioned upon the machine platen 12, a garment such as a T-shirt 74 having a pocket 72 can then be placed directly over the top surface of the platen 50. With the garment pocket 72 (or perhaps another predetermined small are of the garment) positioned upon the small platen 50, the silk screen 82 can then be lowered in conventional manner and the screened design can be applied over only that area of the garment that is supported upon the top or printing surface 84 of the small platen 50. The screen design will thus only be applied to that area of the garment (the pocket) that is comparable to the area of the small platen. It will be appreciated that the remainder of the garment will fall by gravity over the sides of the small platen 50 and therefore cannot be contacted by the screen 82. Accordingly, only that precise area supported upon the small platen 50 will be subjected to the screened design. It will be appreciated that by employing the adjustable pocket printing platen 10 of the present invention, it would be possible to design a single silk screen 82 with several logos or pocket designs. Then, by properly locating the small platen 50 relative to the silk screen, any one of the designs could be selected for printing upon the garment.

Although the present invention has been described with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather, only by the scope of the claims appended hereto.

What is claimed is:

1. An adjustable pocket printing platen for use upon the platen of a silk screen printing machine, the machine platen having top and bottom surfaces and left and right marginal areas, comprising:

an elongate, transversely extending frame, the frame comprising at least one, transverse guide rail, the guide rail extending in length a distance that is at least as great as the width of the machine platen;

left and right side flanges respectively secured to and extending from the transverse ends of the guide rail, the side flanges comprising horizontal legs which extend inwardly beneath respective marginal left and right edges of the machine platen;

each of the flange horizontal legs being provided with a platen securing means to contact the machine platen to secure the adjustable pocket printing platen to the machine platen in an infinite number of longitudinally adjusted positions; and a small platen in sliding, transverse engagement upon the transverse guide rail, the small platen including a track to receive the guide rail therewithin, the small platen being provided with means to lock the small platen to the guide rail in any one of an infinite number of transversely adjusted positions;

whereby, the small may be longitudinally and transversely adjusted to any preselected position relative to the printing machine platen.

2. The adjustable pocket printing platen of claim 1 wherein the means to lock the small platen to the guide rail comprises a threaded opening provided in the small platen, the threaded opening being in communication with the small platen guide track.

3. The adjustable pocket printing platen of claim 2 and socket set screw threadedly engaged within the said threaded opening.

4. The adjustable pocket printing platen of claim 1 wherein the transverse rail is fabricated of steel bar stock of rectangular cross section configuration.

5. The adjustable pocket printing platen of claim 1 and a second transverse guide rail in spaced relation from the said one guide rail, the second guide rail being equal in effective length to the said one guide rail.

6. The adjustable pocket printing platen of claim 5 and at least one spacer joining the guide rails, the spacer being adapted to maintain the guide rails in parallel, spaced relationship.

7. The adjustable pocket printing platen of claim 1 wherein the small platen has a top surface and wherein the guide rail supports the top surface of the small platen above the top surface of the machine platen.

8. The adjustable pocket printing platen of claim 1 wherein the said platen securing means comprises a threaded opening in the flange horizontal leg and a thumb screw threadedly engaged in the threaded opening, the thumb screw being adapted to engage the bottom surface of the machine platen.

9. An adjustable pocket printing platen for attaching to the machine platen of a silk screen printing machine comprising:

a pair of spaced guide rails for positioning upon the machine platen in transverse relationship, the guide rails having transverse ends;

a small platen movable along the guide rails, the small platen being of suitable size to support a preselected portion of a garment;

means to secure the small to a guide rail in any one of an infinite number of transversely adjustable positions;

flange means secured to the transverse ends of the guide rails, the flange means comprising securing means to secure the small platen to the machine platen in any one of an infinite number of longitudinally adjustable positions;

whereby only the supported portion of the garment will be imprinted by the silk screen.

10. The adjustable pocket printing platen of claim 9 wherein the guide rails carry the small platen above the machine platen.

11. The adjustable pocket printing platen of claim 10 wherein the means to secure the small platen comprises an opening in the small platen, the opening extending through the small platen sufficiently to reach a guide rail and a fastening device insertable into the opening to contact and bear against the guide rail.

12. The adjustable pocket printing platen of claim 10 wherein the flange means comprises a horizontal leg extending beneath a portion of the machine platen and wherein the securing means is positioned within the horizontal leg.

13. The adjustable pocket printing platen of claim 12 wherein the securing means comprises a threaded opening in the horizontal leg and a thumb screw turnable within the threaded opening, the thumb screw extending in length to contact the machine platen.

14. The method of imprinting a small pattern upon a preselected portion of a garment when using a silk screen printing machine of the type having a machine platen and a printing screen pivotally mounted above the machine platen comprising:

forming a predetermined design in only a portion of the silk screen;

locating a small platen above the machine platen in registry with the design, positioning guide rails on the machine platen and supporting the small platen with the guide rails upon the machine platen;

positioning the preselected portion of the garment upon the small platen and supporting the said portion;

pivotally moving the printing screen into contact with the preselected portion of the garment; and applying printing ink to the preselected portion through the printing screen;

whereby the predetermined design can be applied directly only to the preselected portion of the garment.

15. The method of claim 14 wherein the locating comprises adjusting the longitudinal position of the small platen relative to the machine platen and securing the small platen in the longitudinally adjusted position.

16. The method of claim 15 wherein the locating comprises adjusting the transverse position of the small platen relative to the machine platen and securing the small platen in the transversely adjusted position.

17. The method of claim 16 wherein the locating comprise providing at least one guide rail and moving the small platen along the guide rail.

18. The method of claim 17 wherein the supporting comprises resting the guide rail directly upon the machine platen.

* * * * *